US008529282B1

(12) United States Patent
Westman et al.

(10) Patent No.: US 8,529,282 B1
(45) Date of Patent: Sep. 10, 2013

(54) DAUGHTER CARD ASSEMBLY HAVING A LATCHING SUB-ASSEMBLY WITH A COUPLING ARM EXTENDING IN AN INSERTION DIRECTION

(75) Inventors: John Eugene Westman, Harrisburg, PA (US); Jared Evan Rossman, Dover, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/422,842

(22) Filed: Mar. 16, 2012

(51) Int. Cl.
*H01R 13/625* (2006.01)

(52) U.S. Cl.
USPC ..... 439/345

(58) Field of Classification Search
USPC ..... 439/62, 65, 345, 327, 353, 357
See application file for complete search history.

(56) References Cited

U.S. PATENT DOCUMENTS 5,980,299 A 11/1999 Davis
6,056,574 A 5/2000 Yeomans et al.
6,160,706 A 12/2000 Davis et al.
6,709,283 B2 * 3/2004 Lai ..... 439/327
6,767,230 B2 * 7/2004 Lai ..... 439/153
8,328,565 B2 * 12/2012 Westman et al. ..... 439/108
2003/0129860 A1 * 7/2003 Lai ..... 439/65
2004/0121636 A1 * 6/2004 Lai ..... 439/153
2011/0111614 A1 5/2011 Kato
2011/0263146 A1 10/2011 Su
2013/0034984 A1 * 2/2013 Annis et al. ..... 439/328
2013/0109216 A1 * 5/2013 Chien ..... 439/345

* cited by examiner

*Primary Examiner* — Chandrika Prasad

(57) ABSTRACT

A daughter card assembly including a printed circuit board that defines a board plane and has a mating edge, a trailing edge, and a side edge that extends between the mating and trailing edges. The mating edge extends lengthwise along a longitudinal axis and has electrical contacts positioned therealong. The mating edge is configured to engage a card connector when the mating edge is moved in an insertion direction that is substantially perpendicular to the longitudinal axis. The daughter card assembly also includes a latching sub-assembly that is coupled to the circuit board and extends along the side edge. The latching sub-assembly includes a coupling arm that extends in the insertion direction and has a latch end that is proximate to the mating edge. The latch end is configured to removably couple to the card connector.

20 Claims, 8 Drawing Sheets

DAUGHTER CARD ASSEMBLY HAVING A LATCHING SUB-ASSEMBLY WITH A COUPLING ARM EXTENDING IN AN INSERTION DIRECTION

BACKGROUND OF THE INVENTION

The subject matter described and/or illustrated in the present application relates generally to a daughter card assembly configured to be engaged to a card connector.

Computers, servers, and switches can use numerous types of daughter card assemblies, such as processor and memory modules (e.g. Dynamic Random Access Memory (DRAM), Synchronous Dynamic Random Access Memory (SDRAM), or Extended Data Out Random Access Memory (EDO RAM), and the like). The memory modules are produced in a number of formats such as, for example, Single In-line Memory Modules (SIMM's), Dual In-line Memory Modules (DIMM's), Small Outline DIMM's (SODIMM's), Fully Buffered DIMM's, and the like. The daughter card assemblies may be installed in card connectors that are mounted on a motherboard or other system board.

Daughter card assemblies often include a printed circuit board (PCB) having a mating edge that is received within a card slot of the card connector. When the mating edge is inserted into the card slot, contact pads on both sides of the mating edge engage opposite rows of electrical contacts in the card slot. The daughter card assemblies may also include communication cables that are coupled to the circuit board. However, daughter card assemblies are frequently located in environments where the daughter card assemblies are at risk of being damaged. For instance, the daughter card assemblies may encounter shock and/or vibrations that cause the mating edge to dislodge from the card slot. Also, in some environments, the card connectors are located in drawers that have limited stack heights in which it may be difficult for a person's hand to maneuver a daughter card assembly. Heat sinks, communication cables, and connectors of the daughter card assemblies may also be inadvertently damaged when the daughter card assembly is inserted into or removed from the card connector.

Accordingly, there is a need for a daughter card assembly that is capable of remaining engaged to a card connector in various environments while also protecting other features of the daughter card assembly.

BRIEF DESCRIPTION OF THE INVENTION

In one embodiment, a daughter card assembly is provided that includes a printed circuit board that defines a board plane and has a mating edge, a trailing edge, and a side edge that extends between the mating and trailing edges. The mating edge extends lengthwise along a longitudinal axis and has electrical contacts positioned therealong. The mating edge is configured to engage a card connector when the mating edge is moved in an insertion direction that is substantially perpendicular to the longitudinal axis. The daughter card assembly also includes a latching sub-assembly that is coupled to the circuit board and extends along the side edge. The latching sub-assembly includes a coupling arm that extends in the insertion direction and has a latch end that is proximate to the mating edge and configured to removably couple to the card connector.

Optionally, the latching sub-assembly includes a pair of the coupling arms. The coupling arms define a line-receiving slot therebetween that extends along the board plane. The daughter card assembly may include communication lines (e.g., fiber-optic lines or electrical conductors) that extend through the line-receiving slot between the coupling arms. In some embodiments, the daughter card assembly includes first and second communication sub-assemblies that are mounted to opposite board sides of the circuit board. The first and second communication sub-assemblies may include communication lines of the first and second communication sub-assemblies may extend through the line-receiving slot.

In another embodiment, a daughter card assembly is provided that includes a printed circuit board defining a board plane. The circuit board also includes a mating edge, a trailing edge, and a side edge that extends between the mating and trailing edges. The mating edge extends lengthwise along a longitudinal axis and has electrical contacts positioned therealong. The mating edge is configured to engage a card connector when the mating edge is moved in an insertion direction that is substantially perpendicular to the longitudinal axis. The daughter card assembly also includes a latching sub-assembly that is coupled to the circuit board and extends along the side edge. The latching sub-assembly includes a coupling arm that extends in the insertion direction and has a latch end that is proximate to the mating edge. The latching sub-assembly also includes a joint that joins the coupling arm to the circuit board and permits the coupling arm to flex within a swing plane that is parallel to or coincides with the board plane.

DETAILED DESCRIPTION OF THE INVENTION

Embodiments described herein include daughter card assemblies, card connectors, and communication systems that include the same. The daughter card assembly may include latching assemblies that are configured to engage the card connector and hold the daughter card assembly in a mated or engaged position. The latching assemblies may also be configured to protect or shield (i.e., reduce the likelihood of damage) other features of the daughter card assemblies. By way of example only, the daughter card assemblies may be processor and memory modules (e.g. Dynamic Random Access Memory (DRAM), Synchronous Dynamic Random Access Memory (SDRAM), or Extended Data Out Random Access Memory (EDO RAM), and the like). The daughter card assemblies may be produced in a number of formats such as, for example, Single In-line Memory Modules (SIMM's), Dual In-line Memory Modules (DIMM's), Small Outline DIMM's (SODIMM's), Fully Buffered DIMM's, and the like. The daughter card assemblies may be used in, for example, computing systems, servers, switches, and the like.

Figure 1:
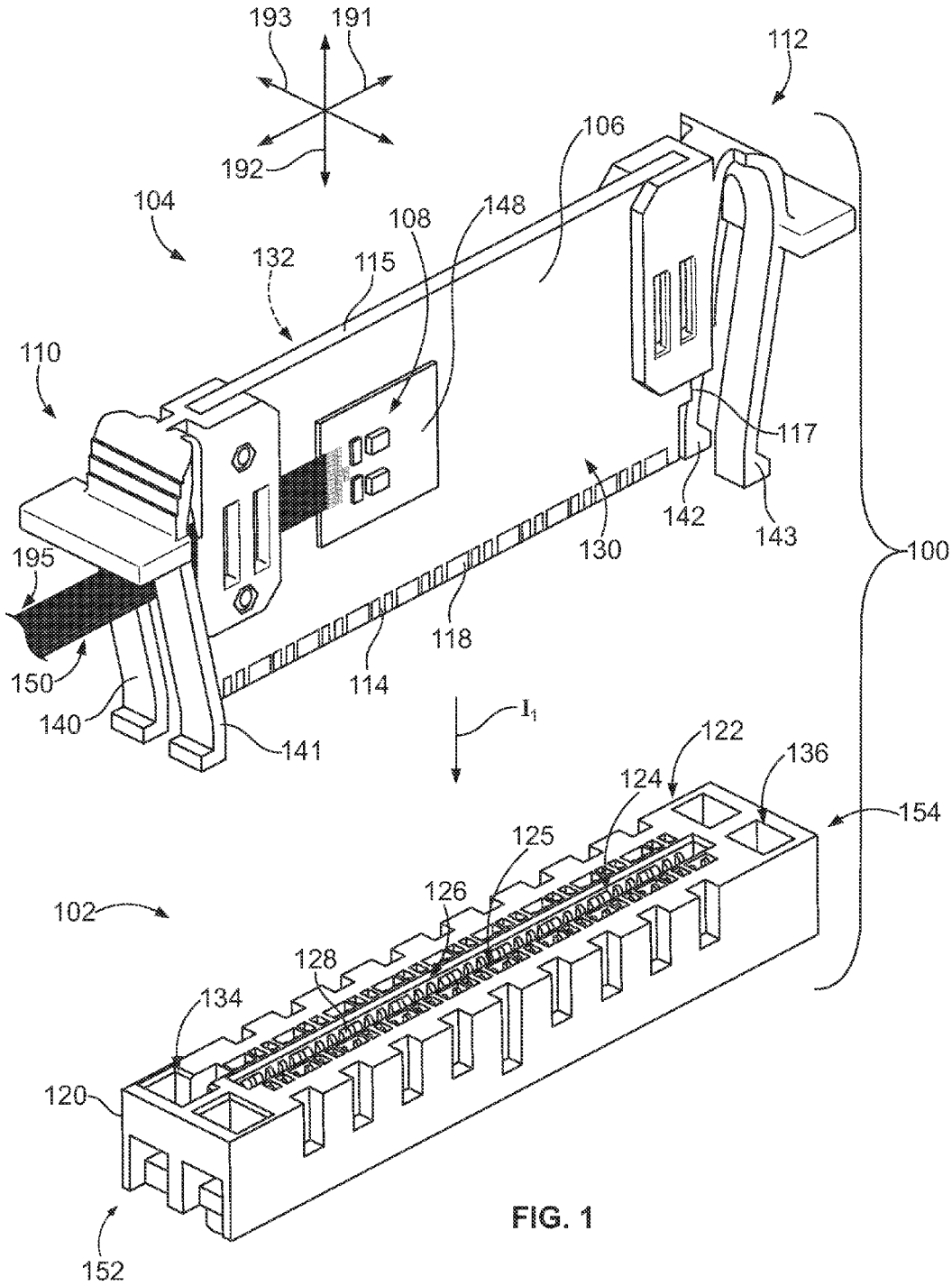
FIG. 1 is a perspective view of a communication system that includes a card connector and a daughter card assembly formed in accordance with one embodiment.
Figure 2:
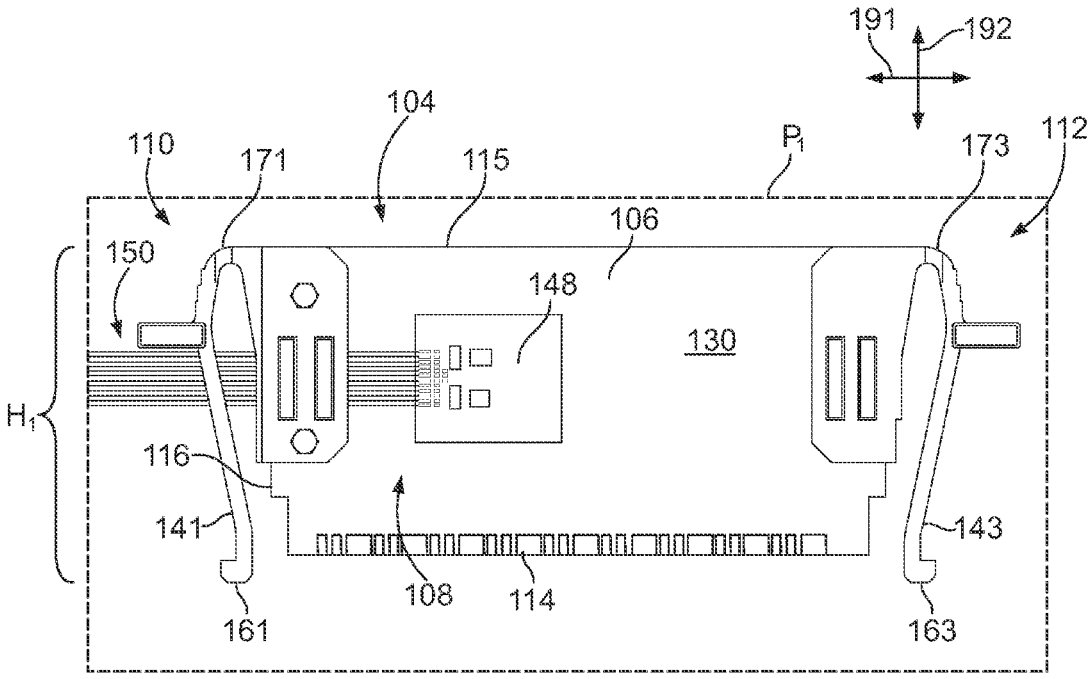
FIG. 2 is a plan view of one board side of the daughter card assembly of FIG. 1.

FIG. 1 is a perspective view of a communication system 100 that includes a card connector 102 and a daughter card assembly 104 formed in accordance with one embodiment. The communication system 100 is oriented with respect to mutually perpendicular axes 191-193, including a longitudinal axis 191, an insertion axis 192, and a lateral axis 193. The daughter card assembly 104 includes a circuit board 106, a communication assembly 108 (or sub-assembly), and first and second latching assemblies 110, 112 (or sub-assemblies). The circuit board 106 has a planar body with opposite board sides 130, 132. The circuit board 106 is defined by a plurality of board edges that include a mating edge 114, a trailing edge 115, and side edges 116, 117 that extend between the mating and trailing edges 114, 115. (The side edge 116 is shown in FIG. 2.) The mating edge 114 extends lengthwise along the longitudinal axis 191 and includes an array of electrical contacts 118 positioned therealong on the board side 130. The mating edge 114 may also include an array of electrical contacts 119 (shown in FIG. 3) positioned along the mating edge 114 on the board side 132. In the illustrated embodiment, the electrical contacts 118, 119 are arranged in corresponding rows.

The latching assemblies 110, 112 are coupled to the circuit board 106 and extend generally along the side edges 116, 117 toward the mating edge 114. The latching assembly 110 includes coupling arms 140, 141 that extend generally along the side edge 116 toward the mating edge 114, and the latching assembly 112 includes coupling arms 142, 143 that extend generally along the side edge 117 toward the mating edge 114.

The communication assembly 108 may be an optical communication assembly or may be an electrical communication assembly, such as a high speed electrical connector. The communication assembly 108 includes communication lines 150 that are coupled directly or indirectly to the circuit board 106. For example, the communication lines 150 may be soldered or coupled directly to the circuit board 106 using an adhesive or epoxy. Optionally, the communication assembly 108 includes a communication connector 148 that is mounted to the circuit board 106, and the communication lines 150 are coupled to the communication connector 148. The communication connector 148 may be a separable interface with respect to the circuit board 106. In the illustrated embodiment, the communication lines 150 are fiber-optic lines configured to transmit optical signals to and/or from the communication connector 148. In such embodiments, the communication connector 148 is an optical connector (e.g., signal converter) that is configured to convert electrical signals to optical signals and optical signals to electrical signals. In other embodiments, the communication lines 150 may be electrical conductors (e.g., wires) and the communication connector 148 may be an electrical connector. The electrical connector may mechanically and communicatively couple the communication lines to the circuit board 106. The communication lines 150 extend to a remote location, which is indicated generally as 195. The remote location 195 may be, for example, another termination with a connector or other device.

The card connector 102 is configured to be mounted to a circuit board (not shown), such as a motherboard. The card connector 102 has a connector housing 120 that extends lengthwise along the longitudinal axis 191. The connector housing 120 has a connector-receiving face 122 that faces the daughter card assembly 104 in a direction along the insertion axis 192. The connector-receiving face 122 has a card slot 124 that is configured to receive the mating edge 114. The card connector 102 includes opposite rows 125, 126 of electrical contacts 128 in the card slot 124. Also shown in FIG. 1, the connector housing 120 may include latch openings 134, 136 at opposite housing ends 152, 154 with the card slot 124 therebetween. In the illustrated embodiment, there are two latch openings 134 at the housing end 152 of the card slot 124 and two latch openings 136 at the housing end 154. In alternative embodiments, there may be only one latch opening at one or both of the housing ends.

When the daughter card assembly 104 is moved to engage the card connector 102, the mating edge 114 is moved along the insertion axis 192 in an insertion direction $I_1$. The insertion direction $I_1$ is substantially perpendicular to the longitudinal axis 191. The mating edge 114 is inserted into the card slot 124. As the mating edge 114 advances into the card slot 124, the row 125 of electrical contacts 128 engages the electrical contacts 118 along the board side 130 and the row 126 of electrical contacts 128 engages the electrical contacts 119 along the board side 132.

Figure 3:
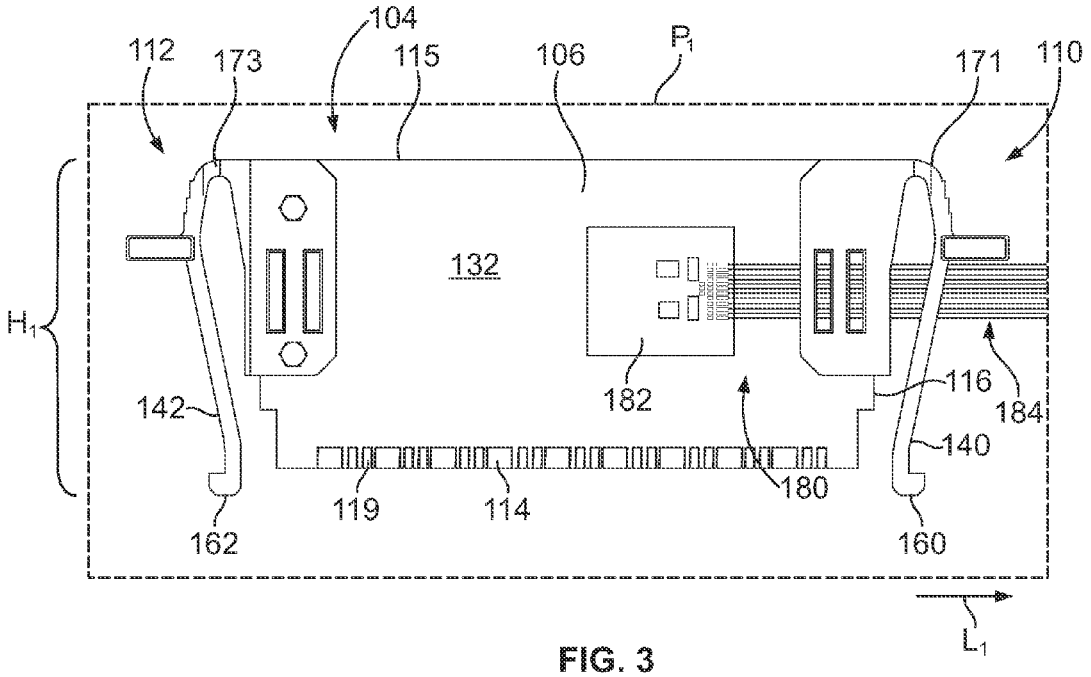
FIG. 3 is a plan view of the other board side of the daughter card assembly of FIG. 1.

FIGS. 2 and 3 are plan views of the daughter card assembly 104 and, more particularly, the board side 130 and the board side 132, respectively, of the circuit board 106. As shown, the circuit board 106 extends along and defines a board plane $P_1$. The board plane $P_1$ extends parallel to the longitudinal and insertion axes 191, 192 (only shown in FIG. 2). As shown in FIGS. 2 and 3, the latching assembly 110 includes a joint 171, and the latching assembly 112 includes a joint 173. The coupling arms 140, 141 extend from the joint 171, and the coupling arms 142, 143 extend from the joint 173. As shown in FIG. 2, the coupling arms 141, 143 have respective latch ends 161, 163. In FIG. 3, the coupling arms 140, 142 have respective latch ends 160, 162.

In the illustrated embodiment, the coupling arms 140-143 extend at least partially back toward the circuit board 106. The joint 171 and the latch end 161 are substantially aligned with each other along the insertion axis 192. The coupling arms 140-143 are configured to move about the respective joints 171, 173 relative to the circuit board 106. For example, in the illustrated embodiment, the coupling arms 140-143 are configured to be deflected toward the circuit board 106 as the respective latch ends 160-163 engage the connector housing 120 (FIG. 1). To release the daughter card assembly 104, the coupling arms 140-143 may be pressed toward the circuit board 106 by an operator (e.g., individual or machine) so that the latch ends 160-163 are moved toward the circuit board 106. When the coupling arms 140, 141 are deflected inward or pressed inward, the coupling arms 140, 141 may flex about the joint 171, and the coupling arms 142, 143 flex about the joint 173. Although the illustrated embodiment shows the coupling arms 140, 141 sharing the joint 171 and the coupling arms 142, 143 sharing the joint 173, each of the coupling arms 140-143 may have a corresponding joint that is not shared by others.

As shown in FIG. 3, the daughter card assembly 104 also includes a communication assembly 180 that has a communication connector 182 mounted to the board side 132 and communication lines 184 that are terminated to the communication connector 182. In some embodiments, the communication assembly 180 and the elements thereof may be identical to the communication assembly 108 (FIG. 2). However, in other embodiments, the communication connector 182 and the communication lines 184 may have different configurations. Also, in the illustrated embodiment, the communication lines 184 and the communication lines 150 (FIG. 2) extend alongside the circuit board 106 in a common direction and clear the circuit board 106 and the latching assembly 110 at the side edge 116. In other embodiments, the communication lines 150, 184 may extend in different directions and clear the circuit board at different hoard edges.

In some embodiments, the communication lines 150, 184 are configured to extend away from the circuit board 106. For example, the communication lines 150, 184 extend along the respective board sides 130, 132 and parallel to the board plane $P_1$. As the communication lines 150, 184 clear (e.g., extend beyond) the side edge 116 and/or the latching assembly 110, the communication lines 150, 184 extend in a longitudinal direction $L_1$ (FIG. 3) that is perpendicular to the insertion direction $I_1$ (FIG. 1). The longitudinal direction $L_1$ is parallel to the longitudinal axis 191 (FIG. 1).

The daughter card assembly 104 has a height $H_1$ that is measured along the insertion axis 192. In the illustrated embodiment, the height $H_1$ extends from the trailing edge 115 of the circuit board 106 to the latch ends 160-163 of the latching assemblies 110, 112. The latch ends 160-163 may be proximate to the mating edge 114. For example, in the illustrated embodiment, the coupling arms 140-143 extend beyond the mating edge 114 such that the latch ends 160-163 lead the daughter card assembly 104 when engaging the card connector 102 (FIG. 1). In such embodiments, the latch ends 160-163 may facilitate aligning the mating edge 114 so that the mating edge 114 is received by the card slot 124 (FIG. 1). However, in other embodiments, the latch ends 160-163 may be substantially even with the mating edge 114 or the mating edge 114 may lead the daughter card assembly 104 such that the mating edge 114 engages the card connector 102 before the latch ends 160-163.

In particular embodiments, the communication connectors 148 (FIG. 2), 182 (FIG. 3) include one or more heat sinks (not shown). The communication connectors 148, 182 and the heat sinks may be exposed to the operational environment that surrounds the daughter card assembly 104. As such, air that flows through the environment may carry thermal energy away from the daughter card assembly 104. For instance, the daughter card assembly 104 may be open-sided along the board sides 130, 132. More specifically, the daughter card assembly 104 may not include a housing that surrounds the circuit board 106. In alternative embodiments, the daughter card assembly 104 includes a housing that surrounds the communication connectors 148, 182 and/or portions of the latching assemblies 110, 112.

Figure 5:
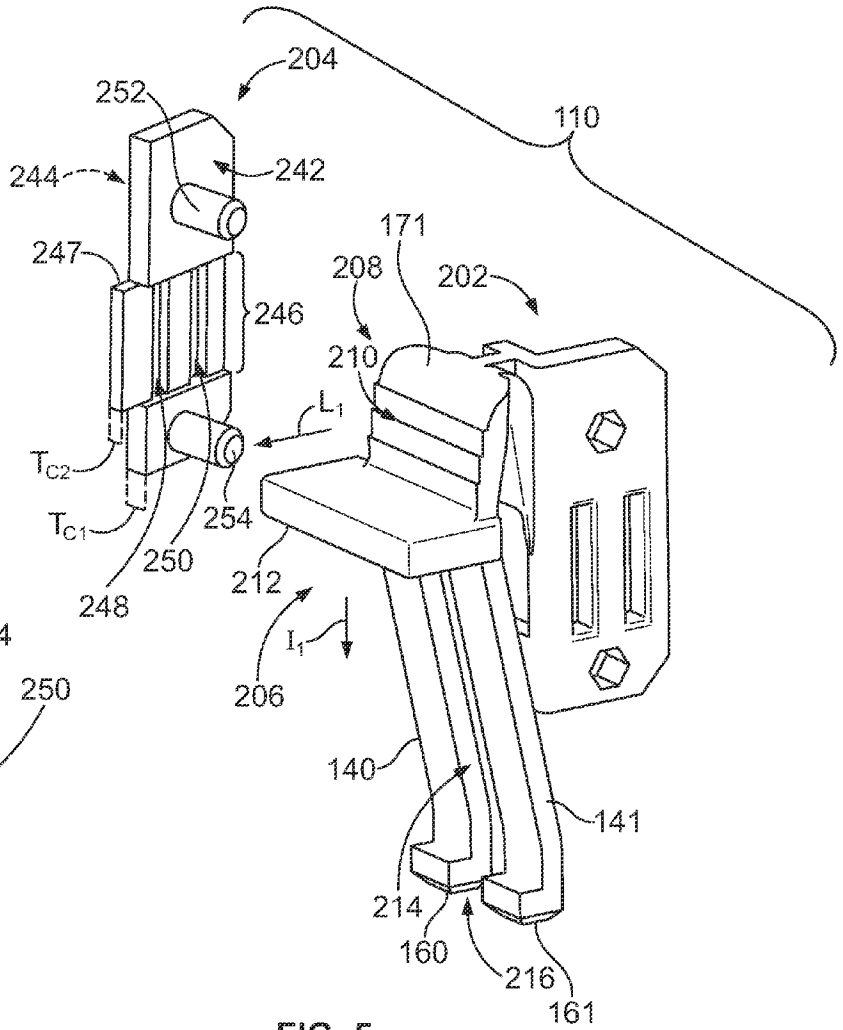
FIG. 5 is another exploded perspective view of a latching assembly that may be used with the daughter card assembly of FIG. 1.
Figure 4:
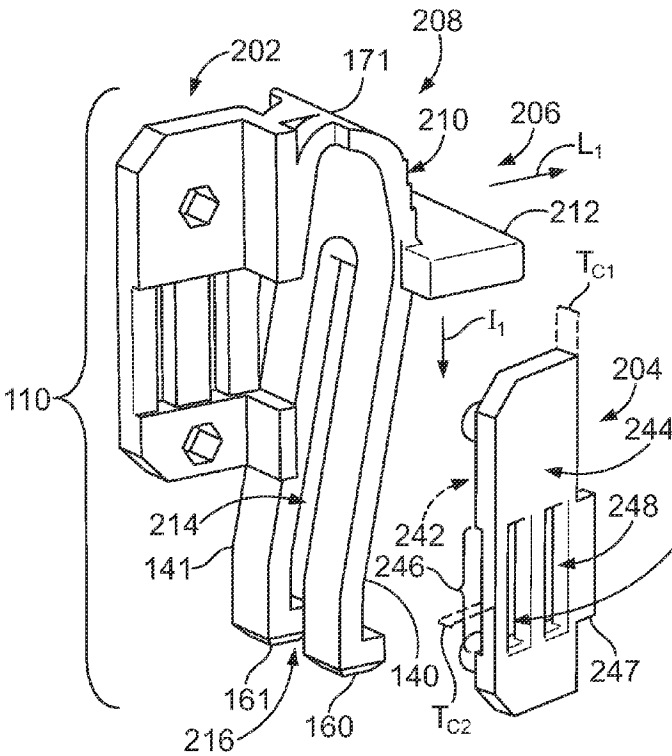
FIG. 4 is an exploded perspective view of a latching assembly that may be used with the daughter card assembly of FIG. 1.

FIGS. 4 and 5 are exploded views of the latching assembly 110. In the illustrated embodiment, the latching assemblies 110, 112 (FIG. 1) are identical. Thus, the following description may also be applied to the latching assembly 112. However, it should be noted that the latching assemblies 110, 112 are not required to be identical. For example, in other embodiments, the latching assemblies 110, 112 may include only some features that are the same but other features that are not.

As shown in FIGS. 4 and 5, the latching assembly 110 includes first and second cover bodies 202, 204 and a spring mechanism 206. The spring mechanism 206 includes the coupling arms 140, 141 and the joint 171. The joint 171 joins the coupling arms 140, 141 to the cover body 202. In the illustrated embodiment, the spring mechanism 206 and the cover body 202 are integrally formed with each other such that the cover body 202 and the spring mechanism 206 are part of a single continuous element. For example, the cover body 202 and the spring mechanism 206 may be molded or die-cast from the same material. Various types of material may be used to form the cover body 202 and/or the spring mechanism 206, including plastic material, metallic material, or a combination thereof.

However, in other embodiments, the cover body 202 may be separate from the spring mechanism 206 but be configured to be coupled to the spring mechanism 206 through, for example, a fastener or frictional engagement. In other embodiments, each of the cover bodies 202, 204 may be separate from the spring mechanism 206. Yet in other embodiments, each of the cover bodies 202, 204 may be integrally formed with the spring mechanism 206 such that the entire latching assembly 110 is a single continuous element.

The cover body 204 has opposite inner and outer surfaces 242, 244. The inner surface 242 is configured to face the circuit board 106 (FIG. 1) and the outer surface 244 is configured to face away from the circuit board 106. As shown, the inner and outer surfaces 242, 244 define a thickness $T_{C1}$ and a thickness $T_{C2}$ that is less than the thickness $T_{C1}$. The cover body 204 may provide a recessed portion 246 where the thickness $T_{C2}$, exists. In some embodiments, the recessed portion 246 is sized and shaped to provide a gap between the recessed portion 246 and the circuit board 106 wherein the gap is substantially equal to or greater than cross-sectional dimensions of the communication lines 150 (FIG. 1) so that the communication lines 150 are not clamped by the cover body 204.

The cover body 204 may include body slots 248, 250 that extend through the outer surface 244 and the inner surface 242. The body slots 248, 250 may be located along the recessed portion 246 such that the body slots 248, 250 extend through the thickness $T_{C2}$. The recessed portion 246 may include an extension 247 that projects away from the cover body 204. Also shown in FIG. 5, the cover body 204 may include attachment posts 252, 254 that project away from the inner surface 242.

As shown in FIGS. 4 and 5, the coupling arms 140, 141 of the spring mechanism 206 have a line-receiving slot 214 that extends between the coupling arms 140, 141. The line-receiving slot 214 is configured to have the communication lines 150 (FIG. 1), 184 (FIG. 3) extend therethrough to the remote location 195 (FIG. 1). When the latching assembly 110 is attached to the circuit board 106 as shown in FIG. 3, the line-receiving slot 214 extends along the side edge 216 and the board plane $P_1$ in the insertion direction $I_1$. In an exemplary embodiment, the board plane $P_1$ extends through the line-receiving slot 214. However, in other embodiments, the board plane $P_1$ may extend adjacent to the line-receiving slot 214.

In the illustrated embodiment, the line-receiving slot 214 extends continuously between the coupling arms 140, 141 to the latch ends 160, 161. The latch ends 160, 161 have a slot gap 216 that provides access to the line-receiving slot 214. Accordingly, the coupling arms 140, 141 are separate and capable of moving independently of each other. However, in other embodiments, the latching assembly 110 does not include the separate coupling arms 140, 141, but may include only one coupling arm having one latch end. In such embodiments, the line-receiving slot 214 may extend through the single coupling arm but not completely to the corresponding latch end such that the slot gap 216 does not exist. Alternatively, the coupling arm does not include a line-receiving slot 214. In such embodiments, the communication lines 150 may extend proximate to and pass over the coupling arm.

The spring mechanism 206 may also include an operator-actuated portion 208 that includes a grip surface 210 and, optionally, a guard feature 212. In an exemplary embodiment, the operator-actuated portion is located proximate to the trailing edge 115 (FIG. 1). The grip surface 210 may have a serrated or otherwise textured surface that enhances grip of an individual's finger on the grip surface 210. The grip surface 210 generally faces in the longitudinal direction $L_1$. In some embodiments, the grip surface 210 is configured to be pressed by the operator in a direction along the longitudinal axis 191 that is opposite the longitudinal direction $L_1$ to actuate the coupling arms 140, 141.

In the illustrated embodiment, the latching assembly 110 includes the two cover bodies 202, 204. However, in other embodiments, the latching assembly 110 may include only one cover body. For example, the latching assembly 110 may include only the cover body 202 and the spring mechanism 206. The cover body 202 may be secured to the circuit board 106 using, for example, screws.

Figure 6:
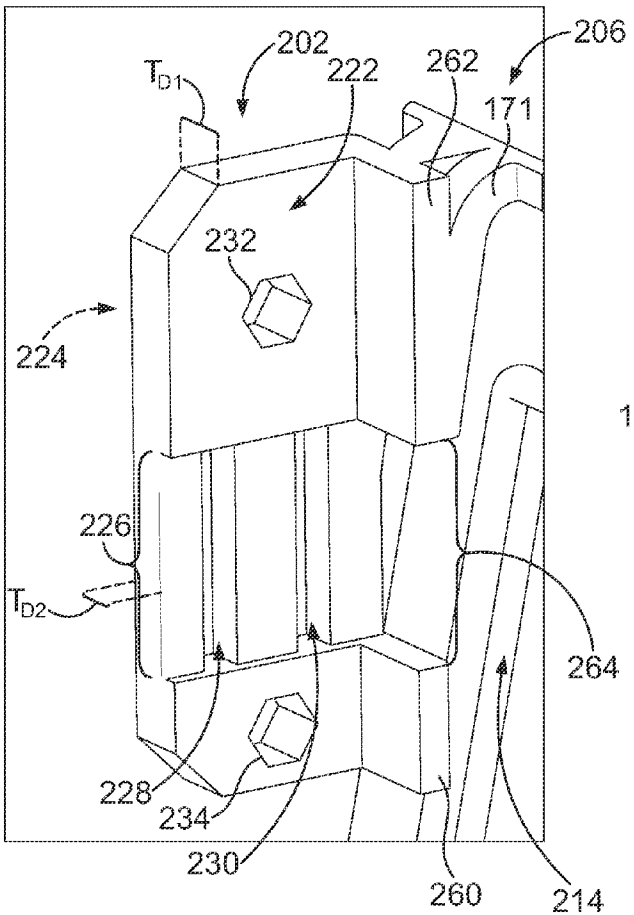
FIG. 6 is an enlarged perspective view of a cover body and a spring mechanism that may be used with the daughter card assembly of FIG. 1.

FIG. 6 is an enlarged view of the cover body 202 and a portion of the spring mechanism 206. The cover body 202 also has opposite inner and outer surfaces 222, 224. The inner surface 222 is configured to face the circuit board 106 (FIG. 1) and the outer surface 224 is configured to face away from the circuit board 106. The inner and outer surfaces 222, 224 define a thickness $T_{D1}$ and a thickness $T_{D2}$ that is less than the thickness $T_{D1}$. The cover body 202 may provide a recessed portion 226 where the thickness $T_{D2}$ exists. In alternative embodiments, the recessed portion 226 may be provided without reducing a thickness of the cover body 202. The cover body 202 also includes body slots 228, 230 that extend through the outer surface 224 and the inner surface 222. The body slots 228, 230 may be located along the recessed portion 226 such that the body slots 228, 230 extend through the thickness $T_{D2}$.

The cover body 202 may include body holes 232, 234 that extend into the thickness $T_{D1}$. The body holes 232, 234 are dimensioned with respect to the attachment posts 252, 254 (FIG. 5), respectively, so that interior walls that define the body holes 232, 234 engage the attachment posts 252, 254 and form a frictional engagement therebetween. For example, the body holes 232, 234 may have polygonal cross-sections (e.g., hexagonal cross-sections) and the attachment posts 252, 254 may have circular cross-sections. In the illustrated embodiment, the cover body 202 includes the body holes 232, 234 and the cover body 204 includes the attachment posts 252, 254. However, in alternative embodiments, the cover body 204 may include holes and the cover body 202 may include corresponding attachment posts.

Also shown in FIG. 6, the cover body 202 may include a side wall 260, and the spring mechanism 206 and/or the cover body 202 may also include a side wall 262. The side walls 260, 262 are configured to engage the side edge 116 (FIG. 2). In the illustrated embodiment, the cover body 202 extends along the circuit board 106 (FIG. 1) parallel to the board plane $P_1$ (FIG. 2) and the side walls 260, 262 extend along a plane that is perpendicular to the board plane $P_1$. An access gap or opening 264 is located between the side walls 260, 262 and is substantially aligned with the recessed portion 226 and the line-receiving slot 214. As shown, the joint 171 may be directly coupled to the side wall 262.

Figure 7:
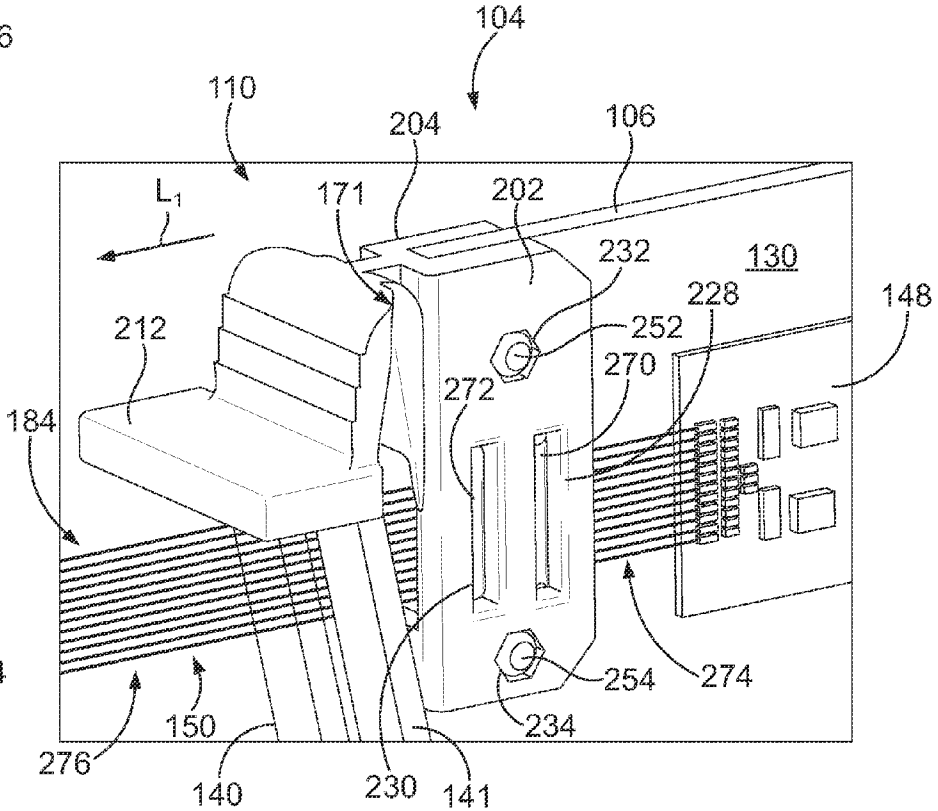
FIG. 7 is a perspective view of the latching assembly gripping a circuit board of the daughter card assembly of FIG. 1.
Figure 12:
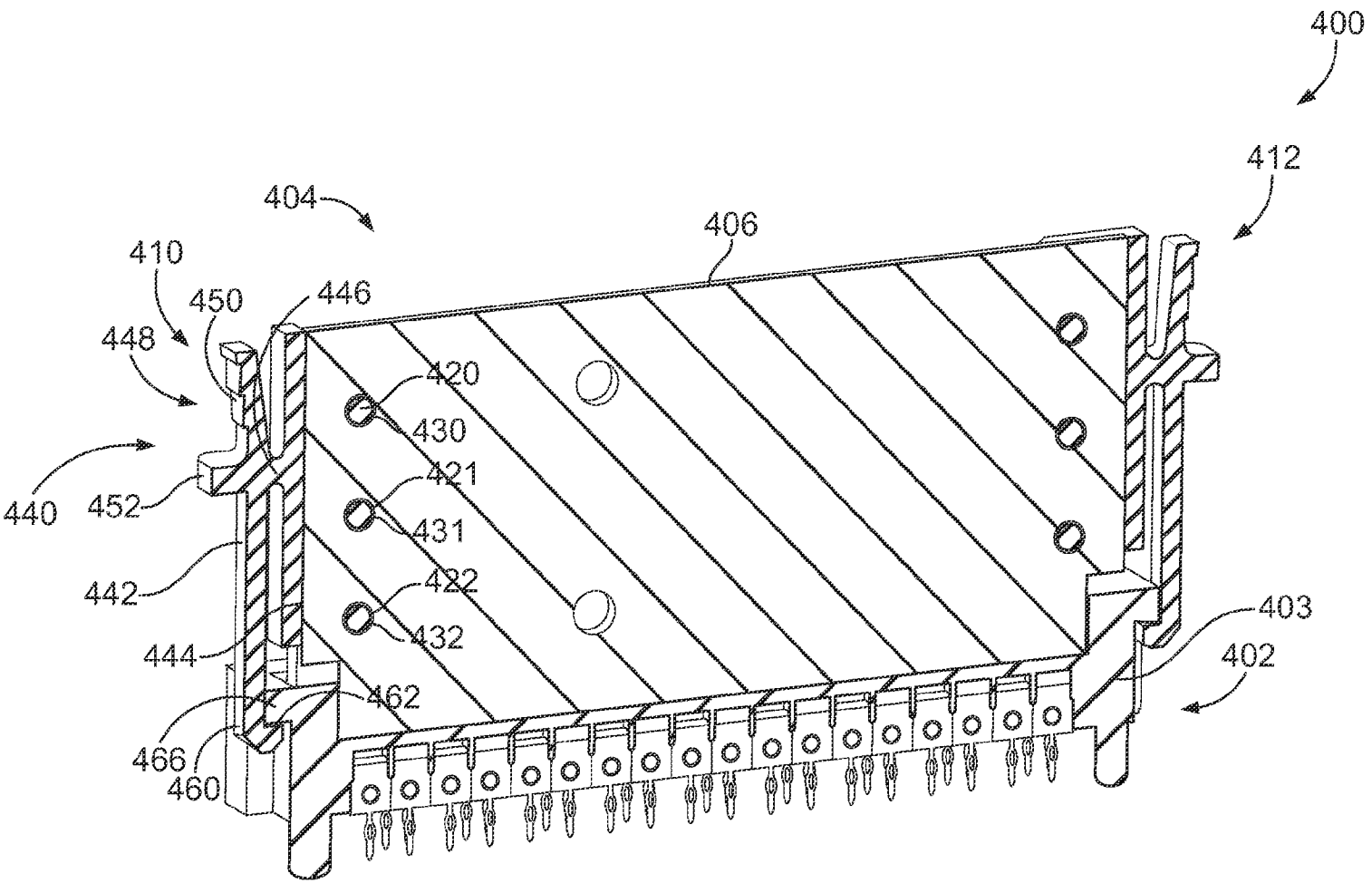
FIG. 12 is a cross-section of a communication system that includes a card connector and a daughter card assembly formed in accordance with one embodiment.

FIG. 7 is a perspective view of the latching assembly 110 when the latching assembly 110 is gripping the circuit board 106. To secure the latching assembly 110 to the circuit board 106, the inner surface 222 (FIG. 6) of the cover body 202 may be pressed against the board side 130 and positioned such that the body holes 232, 234 are aligned with board holes (not shown) of the circuit board 106. The board holes may be similar to the board holes 430-432 that are shown in FIG. 12. The attachment posts 252, 254 may then be inserted through the corresponding board holes and the body holes 232, 234 until the attachment posts 252, 254 frictionally engage the interior walls that define the body holes 232, 234, respectively. The attachment posts 252, 254 may be forced into the respective body holes 232, 234 until the inner surface 242 (FIG. 5) of the cover body 204 abuts the board side 132 (FIG. 1). Accordingly, the circuit board 106 is located between and gripped by the cover bodies 202, 204.

As shown in FIG. 7, the guard feature 212 is sized, shaped, and positioned to shield the communication lines 150, 184 from inadvertent touching by an operator. As shown, the communication lines 150, 184 are located between the guard feature 212 and the card connector 102 (FIG. 1). The guard feature 212 may project away from the circuit board 106 (FIG. 1) in the longitudinal direction $L_1$ and cover the communication lines 150, 184. Thus, when a finger slides down the latching assembly 110 toward the mating edge 114 (FIG. 1), the guard feature 212 may prevent the finger from touching the communication lines 150, 184. In some embodiments, the guard feature 212 may also facilitate actuating the coupling arms 140, 141. For example, the operator may engage the guard feature 212 and press the guard feature 212 in the insertion direction $I_1$ thereby pivoting the arms 140, 141 around the joint 171 and moving the latch ends 160 (FIG. 3), 161 (FIG. 2) toward the circuit board 106. The guard feature 212 may be a plate or panel as shown in FIG. 7. Alternatively, the guard feature 212 may form a cover that surrounds the communication lines 150, 184.

In some embodiments, one or more strain-relief elements 270, 272 may be used to couple (directly or indirectly) the communication lines 150 to the circuit board 106. Although not shown, similar materials may be used to hold the communication lines 184 to the circuit board 106. In an exemplary embodiment, the strain-relief elements 270, 272 may be cured materials that harden to hold the communication lines 150 to the circuit board 106. For example, before or after the cover body 202 is pressed against the board side 130, the material that forms the strain-relief element 270 may be deposited onto the communication lines 150 to initially couple the communication lines 150 to the circuit board 106. In an exemplary embodiment, the material that forms the strain-relief element 270 is first deposited onto the communication lines 150 and the board side 130. After the material is allowed to cure, the cover body 202 may then be positioned along the circuit board 106 as described above so that the strain-relief element 270 is received within the body slot 228. After the latching assembly 110 is secured, the material that forms the strain-relief element 272 may be deposited into the body slot 230 and onto the communication lines 150 and the board side 130.

In an exemplary embodiment, the strain-relief elements 270, 272 are different materials. For example, the strain-relief element 270 may be an adhesive whereas the strain-relief element 272 may be a thermoset material. When the communication lines 150 are coupled to the circuit board 106, the communication lines 150 may include a static portion 274 that extends between the strain-relief element 270 and the communication connector 148 (or the circuit board 106) and a movable portion 276 that extends from the strain-relief element 272 and toward the remote location 195 (FIG. 1). The static portion 274 has a fixed position with respect to the circuit board 106, but the movable portion 276 is permitted to bend and flex when the daughter card assembly 104 is moved.

Figure 8:
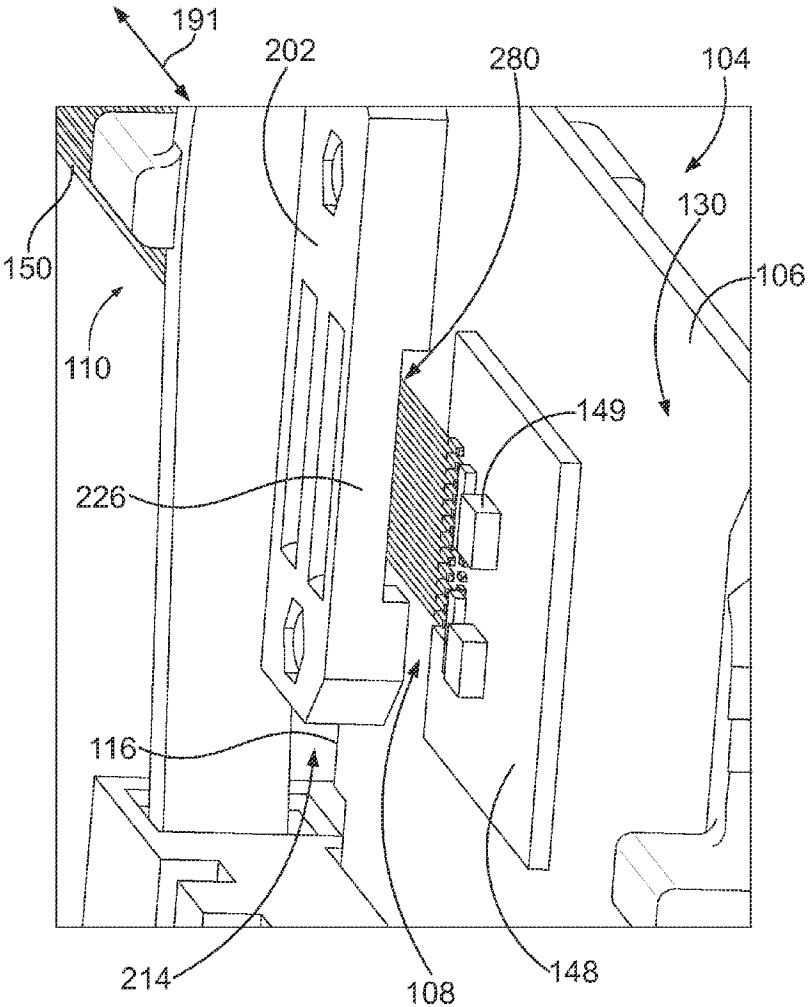
FIG. 8 illustrates the latching assembly and a communication assembly in greater detail.

FIG. 8 is a perspective view of the daughter card assembly 104 illustrating the latching assembly 110 and the communication assembly 108 in greater detail. As shown, the communication lines 150 extend along the board side 130. The communication lines 150 may extend immediately adjacent to the board side 130. For example, the communication lines 150 may contact the board side 130 or be within 10 millimeters of the board side 130. As shown, the communication lines 150 are arranged in a single row and terminated to the communication connector 148. In other embodiments, the communication lines 150 may form multiple rows. In such embodiments in which the communication lines 150 are fiber-optic lines, the communication lines 150 are terminated so that optical signals can be transmitted from the communication connector 148 to the communication lines 150 and/or can be received by the communication connector 148 from the communication lines 150. The heat sinks may be mounted onto the communication connector 148 and configured to dissipate heat therefrom.

The communication connector 148 may be an optical connector (e.g., signal converter) that is configured to receive data signals of a first signal form and convert the data signals into a different second signal form. More specifically, the communication connector 148 may receive electrical signals that are transmitted from the electrical contacts 118 (FIG. 1) and through traces of the circuit board 106 to the communication connector 148. The communication connector 148 may then convert the electrical signals into optical signals that are transmitted to the communication lines 150. In such embodiments, the communication connector 148 may include a modulator (not shown) that receives the electrical signals. The modulator may encode the electrical signals for optical transmission. The communication connector 148 may also include a light source (e.g., LED) (not shown) that is driven by the modulator to produce the optical signals.

The communication connector 148 may also include a detector (not shown) that is capable of detecting the optical signals from the communication lines 150 and converting the optical signals into electrical signals. The electrical signals may be amplified and decoded. In the illustrated embodiment, the communication connector 148 converts electrical signals into optical signals and also converts optical signals into electrical signals.

Also shown in FIG. 8, the recessed portion 226 and the board side 130 may define a passage 280 therebetween. The passage 280 may be substantially aligned with the access gap 264 (FIG. 6) and the line-receiving slot 214 so that the communication lines 150 are not required to bend or curve sharply. For example, the passage 280, the access gap 264, and the line-receiving slot 214 are aligned such that the communication lines 150 may extend in a linear manner along the circuit board 106 from the communication connector 148 to the side edge 116. In an exemplary embodiment, the communication lines 150 extend parallel to the board plane $P_1$ (FIG. 2) and the longitudinal axis 191 (FIG. 1). Also, in an exemplary embodiment, the passage 280 is sized and shaped to permit the communication lines 150 to extend therethrough without the communication lines 150 being deformed by the cover body 202 and/or the board side 130. The passage 280 may also be sized to allow excess material from the stress-relief elements 270, 272 (FIG. 7) to extend into the passage 280.

Figure 9:
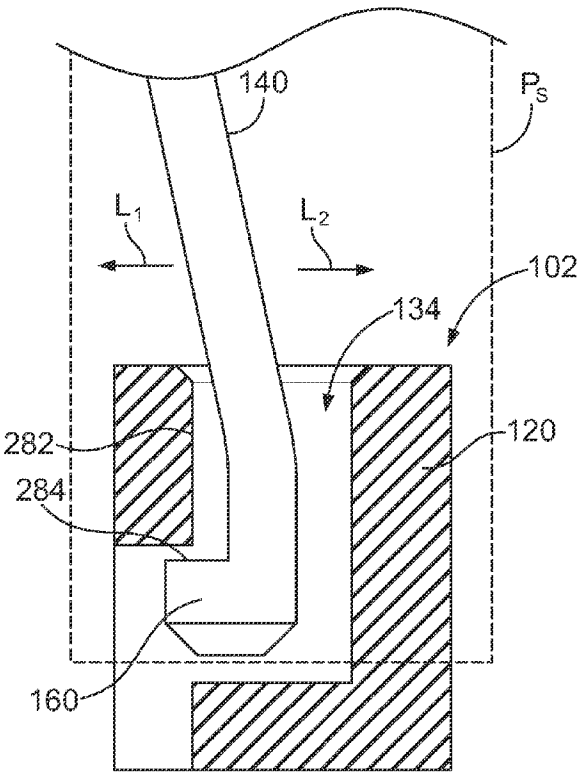
FIG. 9 is a cross-section of a portion of the card connector of FIG. 1 when a latch end of the latching assembly is engaged to the card connector.

FIG. 9 is a cross-section of a portion of the card connector 102 when the latch end 160 is located in the respective latch opening 134 of the connector housing 120. In particular embodiments, the coupling arm 140 is configured to move within a swing plane $P_S$ that is parallel to or coincides with the board plane $P_1$. For example, when the daughter card assembly 104 (FIG. 1) is moved toward the card connector 102, the latch end 160 may engage a reference surface 282 that deflects the latch end 160 in a longitudinal (or actuation) direction $L_2$ that is toward the circuit board 106 (FIG. 1). The coupling arm 140 moves within the swing plane $P_S$ when the latch end 160 is deflected. The reference surface 282 may define at least a portion of the latch opening 134. As the latch end 160 slides against the reference surface 282, the coupling arm 140 may be in a biased position. When the latch end 160 clears the reference surface 282, the latch end 160 springs away from the circuit board 106 in the longitudinal direction $L_1$.

As shown in FIG. 9, the latch end 160 is in a locked position. In the locked position, the latch end 160 may prevent inadvertent removal of the mating edge 114 (FIG. 1) from the card connector 102. As shown, the latch end 160 may include a positive stop 284 that grips the connector housing 120. To release the daughter card assembly 104, the coupling arm 140 may be moved toward the circuit board 106 in the longitudinal direction $L_2$ until the positive stop 284 clears the reference surface 282. The coupling arm 140 may be moved when an operator presses the grip surface 210 (FIG. 5) in the longitudinal direction $L_2$. After the positive stop 284 clears the reference surface 282, the daughter card assembly 104 may then be unmated or withdrawn from the card connector 102.

Figure 10:
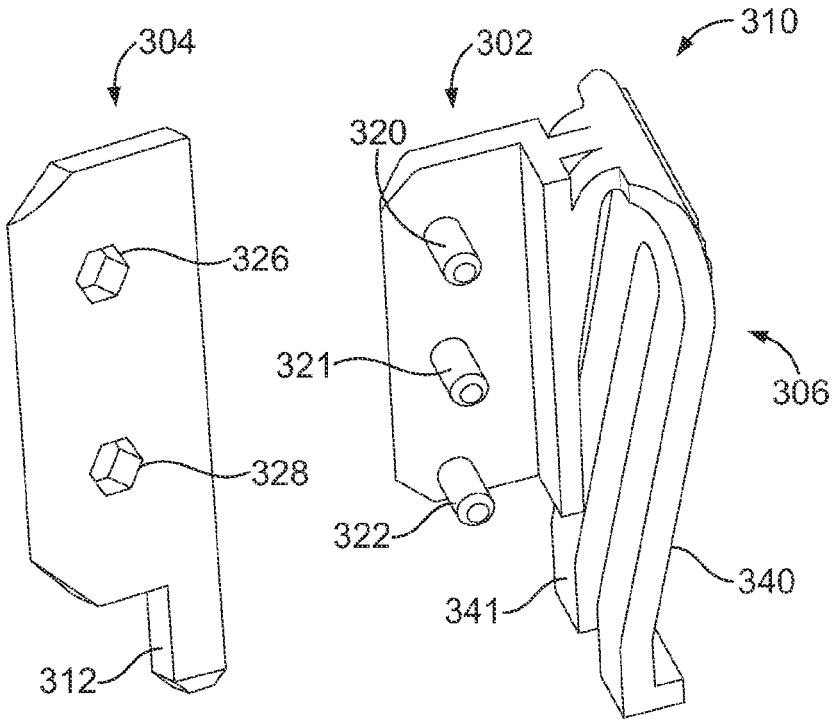
FIG. 10 is an exploded perspective view of a latching assembly formed in accordance with one embodiment.

FIG. 10 is an exploded perspective view of a latching assembly 310 according to one embodiment. The latching assembly 310 is configured to be used in a similar manner as the latching assembly 110 (FIG. 1) and, as such, may include similar elements and features as the latching assembly 110. For example, the latching assembly 310 includes cover bodies 302, 304 and a spring mechanism 306 that includes coupling arms 340, 341. The cover body 302 has three attachment posts 320-322, and the cover body 304 includes two body holes 326, 328. However, the latching assembly 310 may also include features that are not used by the latching assembly 110. For example, the cover body 304 may include a key member 312. The key member 312 projects away from the cover body 304 in an insertion direction.

Figure 11:
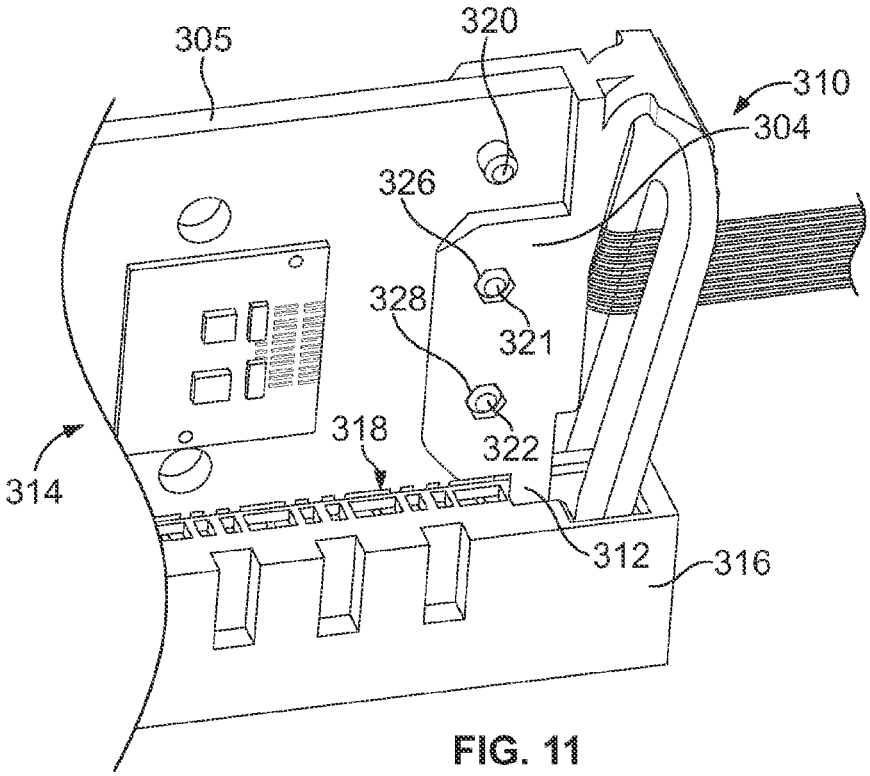
FIG. 11 is a perspective view of a portion of a daughter card assembly that includes the latching assembly of FIG. 10.

FIG. 11 is a perspective view of a portion of a daughter card assembly 314 that includes a circuit board 305 and the latching assembly 310 coupled to the circuit board 305. The circuit board 305 has a mating edge 318 that is configured to engage a card connector 316 in a similar manner as described above with respect to the daughter card assembly 104. In the illustrated embodiment, the cover body 304 may optionally be positioned so that the key member 312 engages the card connector 316 before the mating edge 318 engages the card connector 316. For example, when the latching assembly 310 is assembled, the lower two attachment posts 321, 322 are inserted through the circuit board 305 and through the body holes 326, 328, respectively. In such a configuration, the key member 312 extends beyond the mating edge 318 and would prevent the daughter card assembly 314 from mating with the card connector 316 when the daughter card assembly 314 is in an incorrect orientation. However, the operator may choose to not utilize the key member 312. For example, the body holes 326, 328 may, instead, receive the attachment posts 320, 321, respectively, so that the key member 312 does not project beyond the mating edge 318.

FIG. 12 is a cross-section of a communication system 400 that includes a card connector 402 and a daughter card assembly 404 that are formed in accordance with one embodiment. The card connector 402 has a connector housing 403. The daughter card assembly 404 includes latching assemblies 410, 412 and a circuit board 406 that is coupled to the latching assemblies 410, 412. The latching assemblies 410, 412 may be secured to the circuit board 406 in a similar manner as described above with respect to the latching assembly 110. For instance, and with specific reference to the latching assembly 410, the latching assembly 410 may include cover bodies (not shown) that are coupled using attachment posts 420-422 that are inserted through board holes 430-432, respectively, of the circuit board 406. The attachment posts 420-422 may be frictionally engaged to corresponding body holes (not shown) of one of the cover bodies.

However, the latching assembly 410 is configured to operate differently than the latching assembly 110 (FIG. 1). For instance, the latching assembly 410 may include a spring mechanism 440 having a coupling arm 442 that extends generally along a side edge 444 of the circuit board 406. The coupling arm 442 is joined to at least one of the cover bodies through a joint 446. The coupling arm 442 also includes an operator-actuated portion 448 that includes a grip surface 450 and a guard feature 452. The grip surface 450 may have a serrated or otherwise textured surface that enhances grip between the grip surface 450 and an individual's finger. The guard feature 452 may be similar to the guard feature 212 (FIG. 4) and project away from the circuit board 406.

The coupling arm 442 also includes a latch end 460 having a positive stop 462. Similar to the coupling arms 140, 141 (FIG. 1), the coupling arm 442 is movable within a swing plane that extends parallel to or coincides with a board plane defined by the circuit board 406. During a mating operation, the circuit board 406 is inserted into the card connector 402. The latch end 460 may be deflected away from the circuit board 406 by a ledge 466 of the connector housing 403 and spring back toward the circuit board 406 when the latch end 460 has cleared the ledge 466. As shown in FIG. 12, the coupling arm 442 and the latch end 460 are in a locked position. To release the daughter card assembly 404, the grip surface 450 may be engaged and pressed toward the circuit board 406. The coupling arm 442 may, in turn, swing about the joint 446 such that the latch end 460 moves away from and clears the ledge 466. At such time, the daughter card assembly 404 may be removed.

Figure 13:
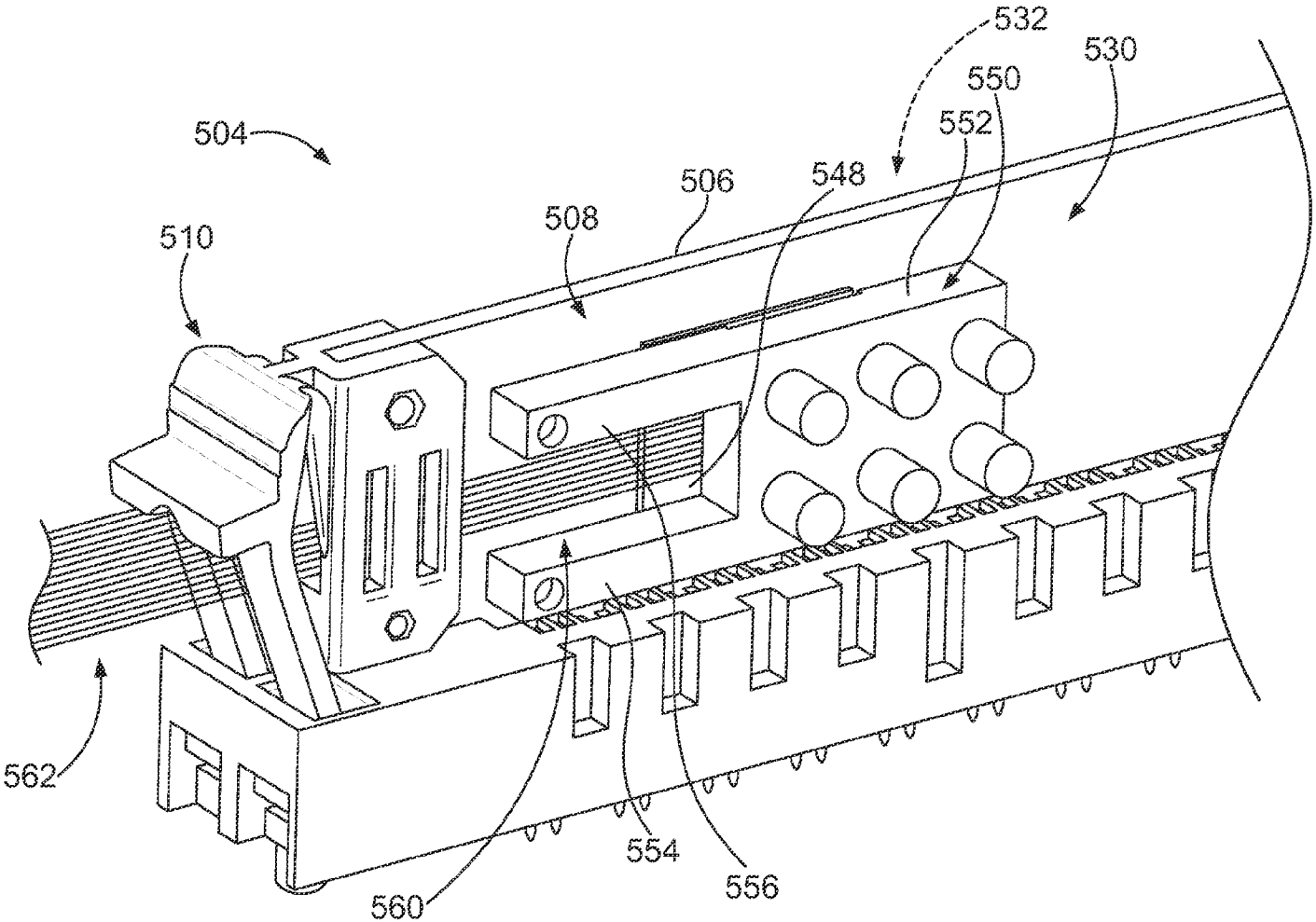
FIG. 13 is a perspective view of a portion of a daughter card assembly in accordance with one embodiment.

FIG. 13 is a perspective view of a portion of a daughter card assembly 504 in accordance with one embodiment. The daughter card assembly 504 may be similar to the daughter card assemblies 104 (FIG. 1) and 404 (FIG. 12) and include similar or identical components and elements. For example, the daughter card assembly 504 includes a circuit board 506, a communication assembly 508, and a latching assembly 510. The circuit board 506 has a planar body with opposite board sides 530, 532. The communication assembly 508 includes a communication connector 548 and a heat sink 550. The communication connector 548 is mounted to the board side 530, and the heat sink 550 is mounted over the communication connector 548 and secured to the circuit board 506 along the board side 530. The heat sink 550 makes intimate contact with the communication connector 548 to absorb thermal energy therefrom. The communication connector 548 and the heat sink 550 may be exposed to the operational environment that surrounds the daughter card assembly 504. As such, air that flows through the environment may carry thermal energy away from the daughter card assembly 504 and, in particular, the communication connector 548 and the heat sink 550. As shown, the daughter card assembly 504 may be open-sided along the board side 530. More specifically, the daughter card assembly 504 may not include a housing that surrounds the circuit board 506.

In the illustrated embodiment, the heat sink 550 includes a thermal-absorbing body 552 and a plurality of projections or legs 554, 556 that extend along the board side 530. The projections 554, 556 are secured to the circuit board 506 using, for example, threaded fasteners (not shown). However, the heat sink 550 may be secured to the circuit board 506 in other manners (e.g., using adhesive or interference fit). The projections 554, 556 define a line-receiving space 560 therebetween. In the illustrated embodiment, communication lines 562 of the communication assembly 508 may extend between the projections 554, 556 and adjacent to the circuit board 506 through the line-receiving space 560. Accordingly, the heat sink 550 may protect or cover the communication lines 562 to prevent inadvertent contact, such as from an individual's hand.

As used herein, an element or step recited in the singular and proceeded with the word "a" or "an" should be understood as not excluding plural of said elements or steps, unless such exclusion is explicitly stated. Furthermore, references to "one embodiment" or "an embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

It is to be understood that the above description and the figures are intended to be illustrative, and not restrictive. For example, the above-described and/or illustrated embodiments (and/or aspects thereof) may be used in combination with each other. In addition, many modifications may be made to adapt a particular situation or material to the teachings of the subject matter described and/or illustrated herein without departing from its scope. Dimensions, types of materials, orientations of the various components (including the terms "upper", "lower", "vertical", and "lateral"), and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description and the figures. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A daughter card assembly comprising:

a printed circuit board defining a board plane and having a mating edge, a trailing edge, and a side edge that extends between the mating and trailing edges, the mating edge extending lengthwise along a longitudinal axis and having electrical contacts positioned therealong, wherein the mating edge is configured to engage a card connector when the mating edge is moved in an insertion direction that is substantially perpendicular to the longitudinal axis; and a latching sub-assembly coupled to the circuit board and extending along the side edge, the latching sub-assembly including a coupling arm that extends in the insertion direction and has a latch end that is proximate to the mating edge, the latch end configured to removably couple to the card connector.

2. The daughter card assembly of claim 1, wherein the coupling arm is movable within a swing plane that is parallel to or coincides with the board plane.

3. The daughter card assembly of claim 1, further comprising a communication sub-assembly including communication lines that are communicatively coupled to the circuit board, the communication lines being terminated directly to the circuit board or coupled indirectly to the circuit board through a connector, the communication lines extending beyond the circuit board to a remote location, wherein the communication lines clear the circuit board at the side edge and extend by the latching sub-assembly.

4. The daughter card assembly of claim 3, wherein the latching sub-assembly includes an operator-actuated portion that is proximate to the trailing edge, the operator-actuated portion having a guard feature that shields the communication lines at the coupling arm.

5. The daughter card assembly of claim 3, further comprising a strain-relief element that couples the communication lines to the circuit board, the communication lines including a static portion that extends from the circuit board to the strain-relief element and a movable portion that extends from the strain-relief element toward the remote location, the static portion having a fixed position with respect to the circuit board.

6. The daughter card assembly of claim 5, wherein the latching sub-assembly includes a cover body that extends over the circuit board, the cover body including a body slot having the strain-relief element therein.

7. The daughter card assembly of claim 3, wherein the latching sub-assembly includes a pair of the coupling arms, the coupling arms defining a line-receiving slot therebetween that extends along the board plane, the communication lines extending through the line-receiving slot between the coupling arms.

8. The daughter card assembly of claim 7, wherein the communication sub-assembly is a first communication sub-assembly and the daughter card assembly includes a second communication sub-assembly that has communication lines, the communication lines of the first and second communication sub-assemblies being coupled to opposite board sides of the circuit board, the communication lines of the first and second communication sub-assemblies extending through the line-receiving slot.

9. The daughter card assembly of claim 1, wherein the latching sub-assembly includes first and second cover bodies that extend over opposite board sides of the circuit board, the circuit board being located between the first and second cover bodies.

10. The daughter card assembly of claim 9, wherein the circuit board includes a board hole, the first cover body having an attachment post that is inserted through the board hole and engages the second cover body.

11. The daughter card assembly of claim 1, further comprising a communication connector coupled to the circuit board and a heat sink that is coupled to the communication connector and configured to dissipate thermal energy therefrom.

12. The daughter card assembly of claim 1, wherein the latching sub-assembly includes a joint that joins the coupling arm to the circuit board, the coupling arm configured to move about the joint.

13. A daughter card assembly comprising:

a printed circuit board defining a board plane and having a mating edge, a trailing edge, and a side edge that extends between the mating and trailing edges, the mating edge extending lengthwise along a longitudinal axis and having electrical contacts positioned therealong, wherein the mating edge is configured to engage a card connector when the mating edge is moved in an insertion direction that is substantially perpendicular to the longitudinal axis; and a latching sub-assembly coupled to the circuit board and extending along the side edge, the latching sub-assembly including a coupling arm that extends in the insertion direction and has a latch end that is proximate to the mating edge, the latching sub-assembly also including a joint that joins the coupling arm to the circuit board and permits the coupling arm to flex within a swing plane that is parallel to or coincides with the board plane.

14. The daughter card assembly of claim 13, further comprising a communication sub-assembly including a communication lines that are communicatively coupled to the circuit board, the communication lines being terminated directly to the circuit board or coupled indirectly to the circuit board through a connector.

15. The daughter card assembly of claim 14, wherein the latching sub-assembly includes a pair of the coupling arms, the coupling arms defining a line-receiving slot therebetween that extends along the board plane, the communication lines extending through the line-receiving slot between the coupling arms.

16. The daughter card assembly of claim 14, wherein the communication sub-assembly is a first communication sub-assembly and the daughter card assembly includes a second communication sub-assembly that has communication lines, the first and second communication sub-assemblies being mounted to opposite board sides of the circuit board, the communication lines of the first and second communication sub-assemblies extending parallel to each other at the side edge.

17. The daughter card assembly of claim 14, wherein the communication lines extend beyond the circuit board to a remote location, wherein the communication lines clear the circuit board at the side edge.

18. The daughter card assembly of claim 13, wherein the latching sub-assembly includes an operator-actuated portion, the operator-actuated portion having a grip surface that is configured to be pressed by an operator in a direction along the longitudinal axis to move the coupling arm within the swing plane.

19. The daughter card assembly of claim 18, wherein the operator-actuated portion is located proximate to the trailing edge.

20. The daughter card assembly of claim 13, wherein the latching sub-assembly includes first and second cover bodies that extend over opposite board sides of the circuit board, the circuit board being located between the first and second cover bodies.

* * * * *